US006094005A

United States Patent [19]

Aibara

[11] Patent Number: 6,094,005

[45] Date of Patent: Jul. 25, 2000

[54] COLOR CATHODE RAY TUBE HAVING FLUORESCENT SUBSTANCE PARTICLES WITH WAVE LENGTH SELECTIVE LAYER

[75] Inventor: Nobumitsu Aibara, Shiga, Japan

[73] Assignee: NEC Corporation, Tokyo, Japan

[21] Appl. No.: 09/066,691

[22] Filed: Apr. 27, 1998

[30] Foreign Application Priority Data

Apr. 28, 1997 [JP] Japan ..... 9-110543

[51] Int. Cl.[7] ..... H01J 29/20

[52] U.S. Cl. ..... 313/470; 313/473; 313/474

[58] Field of Search ..... 313/461, 466, 313/467, 468, 469, 473, 470, 474, 503; 430/27; 428/403, 404; 427/218, 219, 68

[56] References Cited

U.S. PATENT DOCUMENTS

| | | | |
|---|---|---|---|
| Re. 30,015 | 5/1979 | Lipp | 313/470 |
| 3,886,394 | 5/1975 | Lipp | 313/470 |
| 4,339,501 | 7/1982 | Inoue et al. | 428/404 |
| 4,622,272 | 11/1986 | Wengert et al. | 313/503 |

FOREIGN PATENT DOCUMENTS

| | | | |
|---|---|---|---|
| 0 221 715 A1 | 5/1987 | European Pat. Off. | C09K 11/02 |
| 0 391 514 A1 | 10/1990 | European Pat. Off. | C09K 11/02 |
| 0 778 328 A2 | 6/1997 | European Pat. Off. | C09K 11/02 |
| 0 778 329 A2 | 6/1997 | European Pat. Off. | C09K 11/02 |
| 0 836 215 A2 | 4/1998 | European Pat. Off. | H01J 29/18 |
| 8-7800 | 1/1996 | Japan | H01J 31/10 |
| 2 240 213 | 7/1991 | United Kingdom | H01J 29/18 |

OTHER PUBLICATIONS

Kunihiro, I., "Cathode ray tube," *Patent Abstracts of Japan*, Nov. 4, 1983. JPN 58–189288.

Takeshi, T., "Pigment–coated phosphor," *Patent Abstracts of Japan*, Jun. 19, 1991. JPN 03–143987.

Carl, K., et al., "On the limits of the filter concept for color TV screens," *Journal of Electrochemical Soc.,* vol. 128, No. 11, Nov., 1981, pp. 2395–2401.

Ohno, K., et al., "P–42: a high–picture–quality large–area color display improved by the application of ultrafine–pigment color filters," *SID 94 Digest*, Jun. 14, 1994, pp. 584–587.

Fukuda, K. & Ito, T., "The Secret of the Micro Filter Tube: Technology to Improve Brightness and Contrast ", Nov., 1995.

*Primary Examiner*—Michael H. Day
*Attorney, Agent, or Firm*—Whitham, Curtis & Whitham

[57] ABSTRACT

A color cathode ray tube includes black matrix films (31) formed on an inner surface of a glass panel (29) with a predetermined positional relation. The black matrix films (31) have a plurality of light transmission window portions (33, 35, 37), and fluorescent substance films (55) formed by fluorescent substance particles (39, 41, 43) of green, blue, and red at the light transmission portions. In the color cathode ray tube, the fluorescent substance films have wave length selective layers (45, 47) partly coated on a surface of at least one kind of the fluorescent substance particles of green, blue, and red. Each of the fluorescent substance films has a wave length selective characteristic.

5 Claims, 3 Drawing Sheets

COLOR CATHODE RAY TUBE HAVING FLUORESCENT SUBSTANCE PARTICLES WITH WAVE LENGTH SELECTIVE LAYER

BACKGROUND OF THE INVENTION

1. Field of the Invention

The present invention relates to a color cathode ray tube and a method of producing it, and more particularly to a color cathode ray tube in which fluorescent substance forming a fluorescent substance film on an inner surface of a glass panel is coated with a layer having a wave length selective characteristic and a method of producing it.

2. Description of the Prior Art

Conventionally, the color cathode ray tube has been used in color TV, color display and the like. In the color cathode ray tube, a fluorescent substance film is formed on an inner surface of a glass panel. In the fluorescent film, respective patterns are formed for green, blue and red with a predetermined positional relations. On an electron gun side of this fluorescent substance film, attachment is made of color selective electrodes, such as shadow mask or the like, left a predetermined interval therebetween. By this structure, it is adapted in such a manner that electron beams corresponding to green, blue and red are applied onto the fluorescent substances for respectively corresponding colors on the fluorescent substance film, and a light emission is performed.

Generally in the color cathode ray tube, non-luminous absorptive substance such as graphite or the like is loaded between respective color fluorescent substance luminous pixels of green, blue and red (hereinafter referred to as G, B and R) in order to improve contrast which is a basic performance as an image display. This non-luminous absorptive substance film is called black matrix film (hereinafter referred to as BM film). Further on a whole surface of the fluorescent screen which is opposite to the display surfaces a film is formed for reflecting light in the form separated from the fluorescent screen. This film consists, for example, of aluminum film and will be called metal back film.

As described above, contrast is one of the important characteristics of the color cathode ray tube. This contrast is a characteristic which is determined by a ratio between brightness and external light reflection of the fluorescent screen. As a means for improving the contrast, it can be considered to increase a current amount of electron beam from the cathode or raise an anode high voltage. However, this method is not preferable because power consumption of the cathode ray tube becomes large.

Further, it can be considered as another method to increase a light emission performance of the fluorescent substance and a light transmittance of the glass panel. However, the light emission performance of the fluorescent substance has already been at a high level. Further, the light transmittance has almost reached its limit in the glass panel. Thus, it is difficult to improve these characteristics.

A method of lowering a reflectance of the fluorescent screen is disclosed in Japanese Unexamined Patent Publication No. 8-7800 (hereinafter referred to as prior art I). In the method, use is generally made of a mixture of fluorescent substance with pigments. This mixture is produced by attaching inorganic pigment particles having selective absorption property in a region other than luminous wave length of respective color to the whole surfaces of the fluorescent substance particles for blue color and red color.

On the other hand, the fluorescent substance for green color is yellowish in itself and absorbs lights other than the luminous wave length to some extent, so that ordinary pigment is not used. Such mixtures exert an effective absorbing action to external light coming from the glass panel side. However, the pigments are placed on a side of the fluorescent substance onto which the electron beams will impinge, so that the pigments does not only contribute to absorption of external light but also prevents the electron beams from reaching the fluorescent substance, thereby reducing brightness.

As a means for improving the brightness and contrast, a technique for a micro-filter tube (Toshiba) has been introduced in "Electronics" November 1995 (hereinafter referred to as prior art 2). In this technique, a screen of the micro-filter tube comprises color filters (hereinafter referred to as M filters) disposed between an inner surface of a glass panel and fluorescent substance films which respectively consist of fluorescent substance of G, B, R and which are formed between BM films, and a color filter (hereinafter referred to as BE filter) disposed on an outer surface of the glass panel.

The M filters consists of respective colors of G, B, R selectively and absorb wave length regions other than the luminous portion of the fluorescent substance and so absorb external lights effectively without deteriorating the brightness, thereby improving the contrast. On the other hand, the BE filter acts as a common filter for respective colors, so that it can selectively absorb external light energy having luminosity peak, thereby achieving improvement in the contrast and color purity.

However, the color cathode ray tube described above is produced by coating the M filters consisting of respective colors of G, B, R after the BM film has been formed and thereafter forming respective fluorescent substance films at positions corresponding to respective colors. Therefore, the conventional color cathode ray tube has disadvantages in that the production process becomes complicated thereby leading to a drop of yield and that a large equipment investment is needed.

SUMMARY OF THE INVENTION

Accordingly, it is an object of the present invention to provide a color cathode ray tube capable of extracting the characteristics of brightness and contrast to a maximum extent.

It is another object of the present invention to provide a color cathode ray tube capable of suppressing a large equipment investment for production to a minimum extent.

It is still another object of the present invention to provide a method of producing a color cathode ray tube having the aforementioned advantages.

According to one aspect of the present invention, there is provided a color cathode ray tube comprising black matrix films formed on an inner surface of a glass panel with a predetermined positional relation and having a plurality of light transmission window portions, and fluorescent substance films formed by fluorescernt substance particles of green, blue and red at the light transmission window portions. In the aspect of the present invention, the fluorescent substance films have wave length selective layers partly coated on a surface of at least one kind of the fluorescent substance particles of green, blue and red and having a wave length selective characteristic.

Here in the above aspect of the present invention, it is preferable that the wave length selective layer consists of a pigment formed on a surface or at least one kind of the fluorescent substance particles.

Further in the above aspect of the present invention, it is more preferable that the wave length selective layer consists of a pigment coated over a nearly half range of a total surface area of the fluorescent substance particles.

Furthermore in the above aspect of the present invention, it is most preferable that the fluorescent substance particles are formed in such a manner that the wave length selective layer is oriented toward the light transmission window portions on an inner surface of the glass panel.

According to another aspect of the present invention, there is provided a method of producing a color cathode ray tube comprising the steps of forming black matrix films formed on an inner surface of a glass panel with a predetermined positional relation and having light transmission window portions, and forming fluorescent substance films formed by fluorescent substance particles of green, blue and red at the light transmission window portions. In the aspect of the present invention, use is made as the fluorescent substance of one consisting of at least one kind of the fluorescent substance particles of green, blue and red, whose respective surface is partly coated with a wave length selective layer having a wave length selective characteristic.

Here in the aspect of the present invention, it is preferable that as the wave length selective layer there is used one consisting of pigment coated on surfaces of the fluorescent substance particles, or that the wave length selective layer consists of a pigment coated over a nearly half range of a total surface area of the fluorescent substance particles, or that the fluorescent substance films formed by fluorescent substance particles coated with the pigment are formed in such a manner that the wave length selective layer of the fluorescent substance particles is oriented toward the light transmission window portions on an inner surface of the glass panel.

Further in the aspect of the present invention, it is preferable that the wave length selective layer is formed by coating the surfaces of the fluorescent substance particles spread closely in one layer with the pigment from above.

Here, in the method of producing a color cathode ray tube according to the present invention, as the pigment it is possible to use the pigment previously charged in minus and, in this case, the fluorescent substance film may be formed in such a manner that the pigment coated surface is attracted by mutual attraction force action between the pigment and the glass panel maintained at zero potential or plus potential and is positioned in an inner surface side of the glass panel.

Further in the method of producing a color cathode ray tube according to the present invention, the fluorescent substance film may be formed by means of orienting the wave length selective layer toward the light transmission window portions on an inner surface of the glass panel by a gravitational action. Also in this case, it is preferable that the fluorescent substance film formed by the pigment coated fluorescent substance particles is formed in such a manner that the pigment coated surface on which the pigment has been coated over a nearly half range of a total surface area of the fluorescent substance particles is oriented toward the light transmission window portions an inner surface of the glass panel.

DESCRIPTION OF THE PREFERRED EMBODIMENTS

For a better understanding of the present invention, a color cathode ray tube of the prior art will be described before embodiments of the present invention will be explained.

Figure 1:
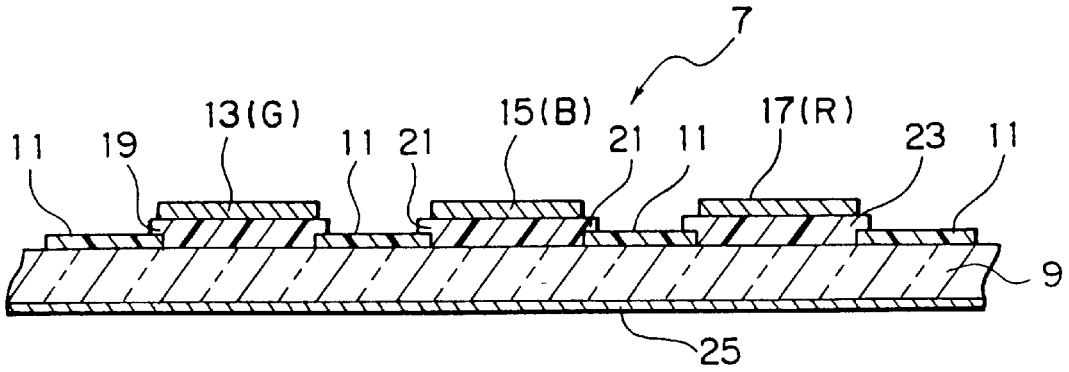
FIG. 1 PRIOR ART
FIG. 1 is a sectional view showing a structure of a micro-filter tube screen according to the prior art 2.

Referring to FIG. 1 depicted in the aforementioned prior art 2, the cathode ray tube is called micro filter tube, and its screen 7 comprises color filters 19, 21, 23 (hereinafter referred to as M filters) disposed between an inner surface of a glass panel 9 and fluorescent substance films 13 (G), 15 (B), 17 (R) which consist respectively of fluorescent substance of G, B, R and which are formed between BM films 11, and a color filter 25 (hereinafter referred to as BE filter) disposed on an outer surface of the glass panel 9.

Next, a method of producing each filter will be explained. In the method of producing the M filters 19, 21, and 23, each filter solution is firstly prepared. In order to obtain this filter solution, inorganic pigment is mixed with dispersant, i.e. water, and then agitated by a dispersing device so as to gain ultrafine particles. Then, patterning is carried out by photolithography by the use of this filter solution. As to the inorganic pigment, for example, cobalt blue ($CoO.Al_2O_3$) or ultramarine blue is used as B, and cobalt green ($TiO_2.CoO.NiO.ZrP_2$) or cobalt green ($CoO.Cr_2O_3.TiO_2.Al_2O_3$) is used as G, and iron oxide ($Fe_2O_3$), cadmium red ($CdS.CdSe$), chrome vermilion ($PbCrO_4.PbMoO_4.PbSO_4$) or the like is used as R.

On the other hand, a filter solution of the BE filter 25 is prepared as follows. Organic pigment is mixed with dispersant, i.e. and alcohol, and agitated by a dispersing device so as to gain ultrafine particles, and then this is mixed with sol-gel solution of $SiO_2/ZrO_2$. As a result, the filter solution is gained.

Next, a filter solution is coated on an outer surface of the glass panel 9 of the cathode ray tube by spinning process. This solution is hardened at a temperature of about 170° C., at which the organic pigment is capable of withstanding, so as to form the BE filter 25. The M filters 19, 21 and 23 correspond to respective colors of G, B and R selectively and absorb a wave length region other than a light emitting portion of the fluorescent substance so as to effectively absorb external light without losing brightness, thereby improving contrast. On the other hand, the BE filter 25 acts as a common filter for the respective colors so as to selectively absorb external light energy having a luminosity peak, thereby achieving improvements in contrast and color purity.

Now, the preferred embodiment of the present invention will be described with reference to the drawings.

Figure 2:
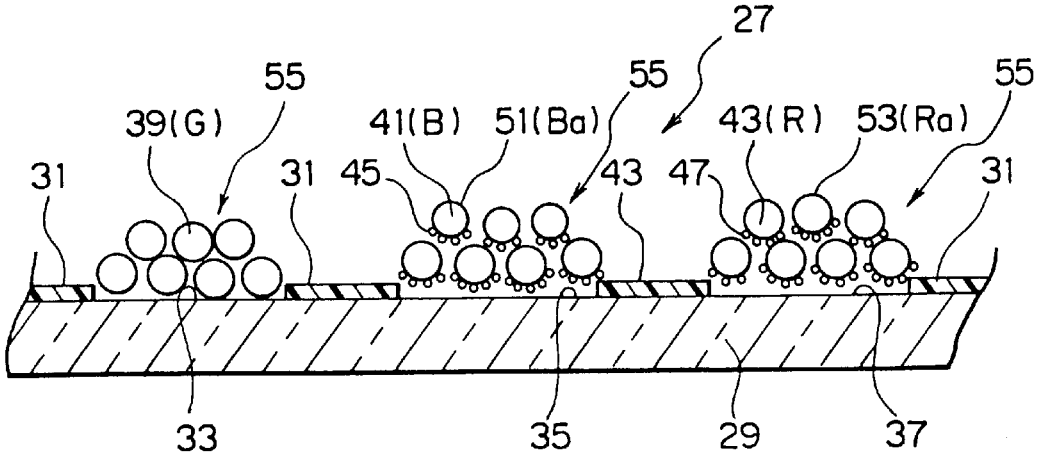
FIG. 2 is a partially enlarged sectional view of a fluorescent substance film formed on an inner surface of a glass panel of a color cathode ray tube according to an embodiment of the present invention.

Referring to FIG. 2, description will be made as regards a screen 27 of the color cathode ray tube according to one embodiment of the present invention. Light transmission window portions 33, 35, 37 in BM film 31 are formed on the inner surface of the glass panel 29 and are respectively coated with G fluorescent substance particles 39(G), B fluorescent substance particles 41(B) and R fluorescent substance particles 43(R). Of them, each of the B and the R fluorescent substance particles 41(B) and 43(R) has a wave length selective layer of a wave length selective characteristic. In the B and the R fluorescent substance particles, total surface areas are coated at nearly half ranges with layers 45, 47 of each specified pigment a so as to form pigment coated fluorescent substance particles 51(Ba), 53(Ra). Further, G fluorescent substance particles 39(G) are not coated with the specified pigment (a). Fluorescent substance films 55, 55, 55 are respectively formed by the above-mentioned particles 51(Ba), 53(Ra) and 39(G).

For each of the fluorescent substance particles, use can be made of one used ordinarily for CRT fluorescent substance. For the B fluorescent substance particles, use is made of one containing $Y_2O_2S$ having Eu as an activator Eu. For the R fluorescent substance particles, use is made of ZnS containing Ag or AgCl. For the G fluorescent substance particles, use is made of ZnS containing Cu, Al. However, the present invention is not restricted to these materials.

As the specified pigments (a), use can be made of CoO—$Al_2O_3$ for B, $Fe_2O_3$ for R, and CoO—$Cr_2O_3$—$TiO_2$ for G, respectively, which are described in the prior art as the pigments (a). However, the present invention is not restricted to those described.

The fluorescent substance films 55 are formed at the respective light transmission window portions 33, 35, 37 and are formed by applying the pigment coated fluorescent particles 51(Ba), 53(Ra) previously coated with the layers 45, 47 of the respective specified pigments (a), which absorbs a light other than a color emitted by the fluorescent substance and reflects a light of the emitted color component, and the G fluorescent substance particles 39(G) not coated with the pigment, to portions positioned in an inner surface side of the glass panel 29. The fluorescent substance film 55 is formed by coating nearly half ranges of total surface areas of the B and R fluorescent substance particles 41(B), 43(R) with the layers 45, 47 of the respective specified pigments a such that the coated surfaces are positioned on an inner surface side of the glass panel 29.

Next, referring to FIGS. 3A, 3B, 3C and 3D, description will be made as regards a method of coating nearly half ranges of the fluorescent substance particles with the layers 45, 47 of the specified pigments (a). That is, the method will be described of coating the fluorescent substance with the pigment, namely coating the nearly half range of the total surface area of the B fluorescent substance particle 41 with the layer 45 of the specified pigment (a) so as to form the pigment coated fluorescent particle 51(Ba).

Figure 3A:
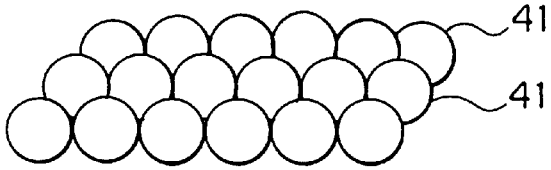
FIGS. 3A, 3B 3C and 3D are explanatory views for use in explaining a method of coating a pigment over a nearly half range of a total surface area of the fluorescent substance particles shown in FIG. 2.
Figure 3B:
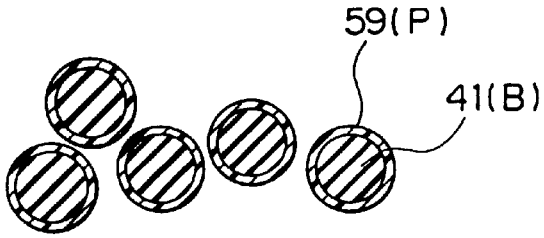
Figure 3C:
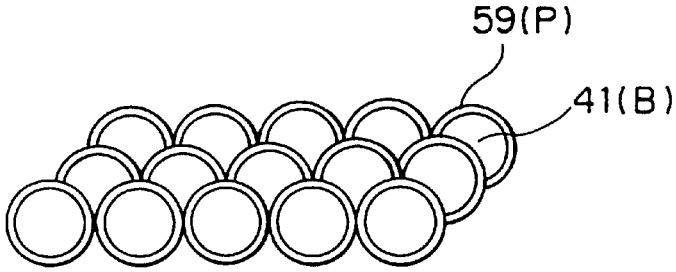
Figure 3D:
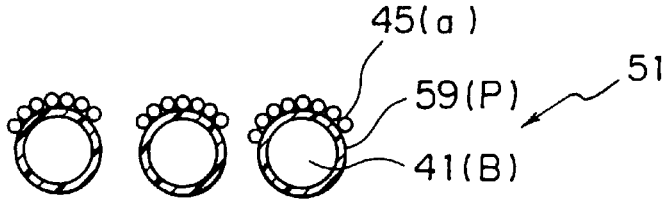

As shown in FIG. 3A, a binder solution is prepared which consists essentially of polyvinyl alcohol (PVA). The binder solution is applied to powder of the B fluorescent substance particles 41. As a result, a binder film 59(P) is formed on the surface of the B fluorescent substance particle 41 as shown in FIG. 3B. Thereafter, the B fluorescent substance particles 41(B) on which the binder film 59(P) has been formed are spread closely and flatly in one layer as shown in FIG. 3C and then the powder 45 of the specified pigment a is coated on a top surface of the B fluorescent substance particle 41(B) as shown in FIG. 3D.

Next, binder film 59(P) is formed on the surface of the B fluorescent substance particle 41(B) and acts as an adhesive. Therefore, the powder 45 adheres in a desired amount of the specified pigment (a) over a nearly half range of the total surface area of the B fluorescent substance particle 41(B). As a result, the pigment coated fluorescent substance particle 51(Ba) is completed. Incidentally, the binder film 59(P) is volatilized by a heat treatment after the fluorescent substance film 55 has been coated. By the way, it is possible to use other solvent materials, such as acrylic resin, although PVA solution is used as the binder solution. The same procedures are performed when the other pigment coated fluorescent substance particle 53(Ra) or pigment coated fluorescent substance particle (Ga) (not shown) which is not used in embodiments of the present invention is used.

Referring to FIG. 2 again, the fluorescent substance films 55 are formed in such a manner that the layers 45, 47 of the specified pigments a applied over the nearly half ranges of the total surface areas of the B and R fluorescent substance particles 41(B), 43(R) face the light transmission window portions 35, 37 on the inner surface of the glass panel 29. Here, description will be made as regards a method of forming the fluorescent substance film 55.

Figure 4A:
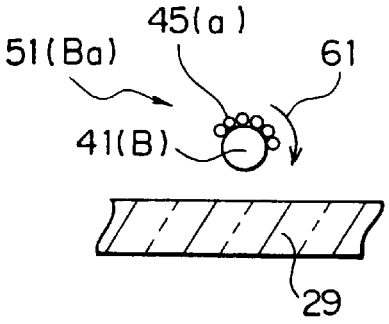
FIGS. 4A and 4B are sectional views showing an example of a method of producing the color cathode ray tube shown in FIG. 2, which explain that the pigment coated fluorescent substance particle is arranged by a gravitational action.
Figure 4B:
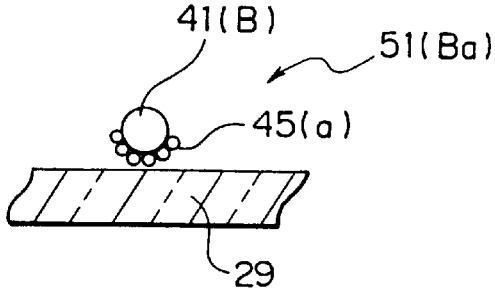

Referring to FIGS. 4A and 4B, description will be made as regards a first method of forming the fluorescent substance film 55. In the method, the film 55 is applied by utilizing a gravitational action owing to self-weight of the pigment coated to the surface of the fluorescent substance particle. When the inner surface of the glass panel 29 is applied with the pigment coated fluorescent substance particle 51(Ba) as an example, a pigment coated side is heavier than one opposite to the pigment coated side in the particle. Naturally the pigment coated side is turned down and the opposite side is turned up by the gravitational action as shown by an arrow 61. As a result, the fluorescent substance film 55 is formed which consists essentially of the pigment coated fluorescent substance particles 51(Ba) whose pigment coated sides are arranged facing the inner surface side of the glass panel 29 as shown in FIG. 2, there is.

Figure 5A:
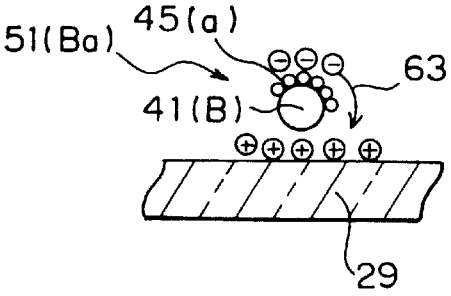
FIGS. 5A and 5B are sectional views showing another example of a method of producing the color cathode ray tube shown in FIG. 2, which explain that the pigment coated fluorescent substance particle is arranged by attracting action of the electric charge.
Figure 5B:
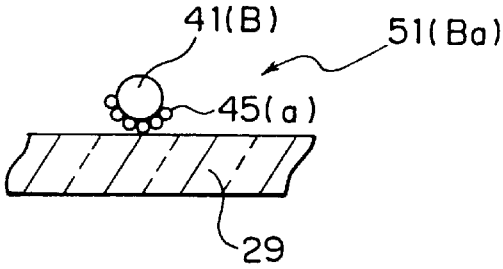

Referring to FIGS. 5A and 5B, description will be made as regards a second example of a method of forming the fluorescent substance film 55. In the method, particles are prepared, each of which consists of the pigment coated fluorescent substance particles 51(Ba). The particles 51(Ba) are coated with the layer 45 of the specified pigment (a) which has been previously charged in minus. When the glass panel 29 is applied on inner surface the inner surface of is applied with the pigment coated fluorescent substance particle 51(Ba), the glass panel 29 is earthed or maintained in plus potential on which the BM film has been formed. The layer 45 has the specified pigment (a) charged in minus in the pigment coated fluorescent substance particle 51(Ba) so as to be attracted by attracting action (see an arrow 63) of the electric charge to the inner surface of the glass panel 29. As a result, the fluorescent substance film 55 is formed regularly on the inner surface side of the glass panel 29 as shown in FIG. 2. Incidentally, the same method is performed as the prior art of applying the G fluorescent substance particle 39(G) not coated with the layer 45 of the specified pigment (a).

As described above, the fluorescent substance film 55 is formed on the inner surface of the glass panel 29 in such a form that the pigment coated surface thereof is positioned on the inner surface of the glass panel 29 according to the color cathode ray tube and the method of producing it in compliance with the present invention. It is, therefore, possible to suppress reflection of the external lights on the fluorescent screen by these layers 45, 47 of the specified pigment. Further, the layers 45, 47 of the pigment a are not coated on an opposite side of the fluorescent substance particle. Therefore, electron beam emitted from an electron gun is irradiated on the fluorescent substance film 55 without attenuating its energy, so that a high light emission can be obtained. On the other hand, use is made for the pigment coated fluorescent substance particles 51(Ba), 53(Ra) on which the pigment a has been coated over nearly half ranges of the total surface areas of the B and R fluorescent substance particles 41(B), 43(R).

Therefore, modification of a fluorescent substance film forming process is small, so that an equipment investment can be reduced.

That is, it is possible to extract the characteristics of brightness and contrast to the maximum extent owing to a structure of the fluorescent substance film 55 according to the present invention. It is, therefore, possible to provide the color cathode ray tube and the method of producing it while suppressing the equipment investment to the minimum extent.

What is claimed is:

1. A color cathode ray tube, comprising:

a glass panel;

black matrix films formed on an inner surface of said glass panel, said black matrix films having a plurality of light transmission window portions with a predetermined positional relation and fluorescent substance films formed by fluorescent substance particles of green, blue and red at said light transmission window portions, wherein said fluorescent substance films have wave length selective layers partly coated on a surface of at least one kind of said fluorescent substance particles of green, blue and red, each of said wave length selective layers having a wave length selective characteristic, and wherein said fluorescent substance particles are formed in such a manner that said wave length selective layers are oriented towards said light transmission window portions on the inner surface of said glass panel.

2. A color cathode ray tube according to claim 1, wherein each of said wave length selective layers includes one or more pigments formed on surfaces of at least one kind of said fluorescent substance particles.

3. A color cathode ray tube according to claim 2, wherein each of said wave length selective layers includes individual particles coated with said pigments over a nearly half range of a total surface area of said individual particles, said individual particles included among said at least kind of said fluorescent substance particles.

4. A color cathode ray tube according to claim 1, wherein said at least one kind of fluorescent substance particles corresponds to those of blue and red.

5. A color cathode ray tube, comprising:

a glass panel;

at least one black matrix film disposed on an inner surface of said glass panel, said black matrix film having a plurality of light transmission window portions;

fluorescent layers disposed in respective ones of said light transmission window portions, each of said fluorescent layers including fluorescent particles which emit one of green, blue, and red when excited by a cathode ray of said tube; and pigment particles disposed on at least one of said fluorescent particles which emit green and blue, said pigment particles absorbing light of all colors except the color emitted by the fluorescent particles on which said pigment particles are disposed, said pigment particles disposed only on a surface of said fluorescent particles facing said light transmission window portions of said black matrix film.

* * * * *